US006761049B2

(12) United States Patent
Nitschmann et al.

(10) Patent No.: US 6,761,049 B2
(45) Date of Patent: Jul. 13, 2004

(54) SEALING SLEEVE

(75) Inventors: Kai Nitschmann, Berlin (DE); Wolfgang Proppe, Berlin (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/328,777

(22) Filed: Dec. 23, 2002

(65) Prior Publication Data

US 2003/0110817 A1 Jun. 19, 2003

Related U.S. Application Data

(63) Continuation of application No. PCT/EP01/07169, filed on Jun. 25, 2001.

(30) Foreign Application Priority Data

Jun. 27, 2000 (DE) ..... 100 31 170

(51) Int. Cl.[7] ..... D06F 23/00; F26B 25/00

(52) U.S. Cl. ..... 68/5 E; 68/20; 34/242; 34/601; 34/603

(58) Field of Search ..... 68/5 E, 20, 24, 68/58, 139; 34/242, 318, 601, 603

(56) References Cited

U.S. PATENT DOCUMENTS

| | | | | |
|---|---|---|---|---|
| 5,860,300 A | | 1/1999 | Valent | 68/24 |
| 6,256,823 B1 | * | 7/2001 | Kronbetter et al. | 8/158 |
| 6,474,351 B1 | * | 11/2002 | Cerruti et al. | 134/99.2 |

FOREIGN PATENT DOCUMENTS

| | | | |
|---|---|---|---|
| DE | 2 403 705 | | 8/1974 |
| DE | 2403705 A | * | 8/1974 |
| GB | 2 114 606 A | | 8/1983 |
| GB | 2 202 014 A | | 9/1988 |
| GB | 2 296 018 A | | 6/1998 |

* cited by examiner

*Primary Examiner*—Joseph L. Perrin
(74) *Attorney, Agent, or Firm*—Laurence A. Greenberg; Werner H. Stemer; Gregory L. Mayback

(57) ABSTRACT

A sealing sleeve seals joints in household appliances, especially the joints between the suds container and the front wall of the housing or the upper part of the suds container and the top frame in washing machines, and can be secured to the appliance by a substantially annular clamping element. The clamping element can be molded into the interior of the section (which can be a beading) of the sealing sleeve to be secured.

15 Claims, 2 Drawing Sheets

SEALING SLEEVE

CROSS-REFERENCE TO RELATED APPLICATION

This application is a continuation of copending International Application No. PCT/EP01/07169, filed Jun. 25, 2001, which designated the United States and was not published in English.

BACKGROUND OF THE INVENTION

FIELD OF THE INVENTION

The present invention relates to a sealing sleeve for sealing joints in household appliances, especially, the joints between the outer drum and the front wall of the housing or the upper part of the suds container and the top frame in washing machines, which sealing sleeve can be secured by a substantially annular clamping element.

In washing machines or laundry dryers, it is important to ensure a suitable seal between the outer drum and the front wall of the housing in front-loading machines and between the upper part of the suds container and the top frame in top-loading appliances. Customarily, sealing sleeves are used for such a purpose and can be secured by conventional clamping elements or clamp/screw elements placed around the sleeve. German Published, Non-Prosecuted Patent Application DE 2 403 705 discloses a sealing sleeve that forms a sealing joint between the suds container of a washing machine, in which the laundry drum is mounted, and the housing wall or the loading door. In this configuration, the sealing sleeve is secured on the suds container pressed against the outer surface of the wall of the suds container by an annular retaining or securing spring.

A disadvantage of this conventional sealing sleeve is that a high degree of effort must be expended to secure the sealing sleeve and due to the fact that the clamping elements have to be attached from the outside and are visible means that no freedom of design is possible with respect to the connection geometry.

SUMMARY OF THE INVENTION

It is accordingly an object of the invention to provide a sealing sleeve for sealing joints in a household appliance that overcomes the hereinafore-mentioned disadvantages of the heretofore-known devices of this general type and that avoids the above disadvantages, so that, in addition to an improved visual appearance, the assembly effort is reduced and the shape of the sections of sealing sleeve to be secured is capable of extremely wide variations in design.

With the foregoing and other objects in view, in a household appliance having an outer drum, a housing with a front wall, joints between the outer drum and the front wall, a suds container with an upper part, a top frame, and joints between the upper part and the top frame, there is provided, in accordance with the invention, a sealing sleeve for sealing at least one of the joints including a section to be secured in the appliance, the section having an interior and a substantially annular clamping element being molded into the interior, securing the section in the appliance, and sealing at least one of the joints.

According to the invention, the clamping element is molded into the interior of the section of the sleeve to be secured. As a result, the on-site assembly effort is substantially reduced and the shape of the sealing sleeve is capable of extremely wide variations in design. Advantageously, moreover, the clamping element is not visible from the outside.

In accordance with another feature of the invention, the section has an outer surface and an annular channel with at least one groove and the channel is connected by the at least one groove to the outer surface of the sealing sleeve and receives the clamping element. Advantageously, the sealing sleeve includes, in its interior, an annular channel, which is connected by at least one groove to the outer surface of the sealing sleeve. Such a configuration ensures that the clamping element is retained firmly and securely in the sealing sleeve but, nevertheless, external access to the clamping element is possible at all times.

Particularly advantageously, in accordance with a further feature of the invention, the clamping element can be pre-mounted in the sealing sleeve before the sealing sleeve is mounted in the household appliance. As a result, the assembly effort when the sealing sleeve is inserted can be still further reduced.

To simplify the production operation, in accordance with an added feature of the invention, it is additionally advantageous to form the sealing sleeve by injection molding.

In accordance with an additional feature of the invention, the clamping element is elastic.

In accordance with yet another feature of the invention, the clamping element is automatically capable of elastic further tensioning.

In accordance with yet a further feature of the invention, the clamping element is a helical spring.

In accordance with yet an added feature of the invention, the clamping element is a helical spring.

The effort of pre-mounting the clamping element in the sealing sleeve is advantageously eliminated if the sleeve already contains the clamping element during injection molding.

In accordance with yet an additional feature of the invention, the clamping element is jointly injected around the sleeve when the sleeve is injection-molded.

In accordance with again another feature of the invention, the clamping element is jointly injected molded with the section.

In accordance with again a further feature of the invention, a front housing wall of the appliance limits a door aperture and has an edge with a curved, substantially annular collar and the section is a beading and, with the clamping element, is adapted to engage with the annular collar.

If a beading of the sealing sleeve is so configured that it comes into engagement with a curved, substantially annular edge region of the end of the front housing wall limiting the door aperture, then a sealing sleeve excellently matched to the washing machine components used hitherto is, advantageously, provided.

With the objects of the invention in view, there is also provided a sealing section for a household appliance, including a body having an interior and a substantially annular clamping element being molded into the interior, the clamping element adapted to secure the section in the appliance and to seal at least one of a joint between an outer drum and a front wall of a housing of the appliance and a joint between an upper part of a suds container and a top frame of the appliance.

With the objects of the invention in view, in a washing machine having an outer drum, a housing with a front wall, joints between the outer drum and the front wall, a suds container with an upper part, a top frame, and joints between the upper part and the top frame, there is also provided a sealing sleeve for sealing at least one of the joints including a section to be secured in the washing machine, the section having an interior and a substantially annular clamping element being molded into the interior, securing the section in the appliance, and sealing at least one of the joints.

With the objects of the invention in view, there is also provided a washing machine, including an outer drum, a housing with a front wall, joints between the outer drum and the front wall, a suds container with an upper part, a top frame, joints between the upper part and the top frame, and a sealing sleeve for sealing at least one of the joints, the sealing sleeve having a section having an interior and a substantially annular clamping element being molded into the interior, securing the section in the appliance, and sealing at least one of the joints.

Other features that are considered as characteristic for the invention are set forth in the appended claims.

Although the invention is illustrated and described herein as embodied in a sealing sleeve for sealing joints in a household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
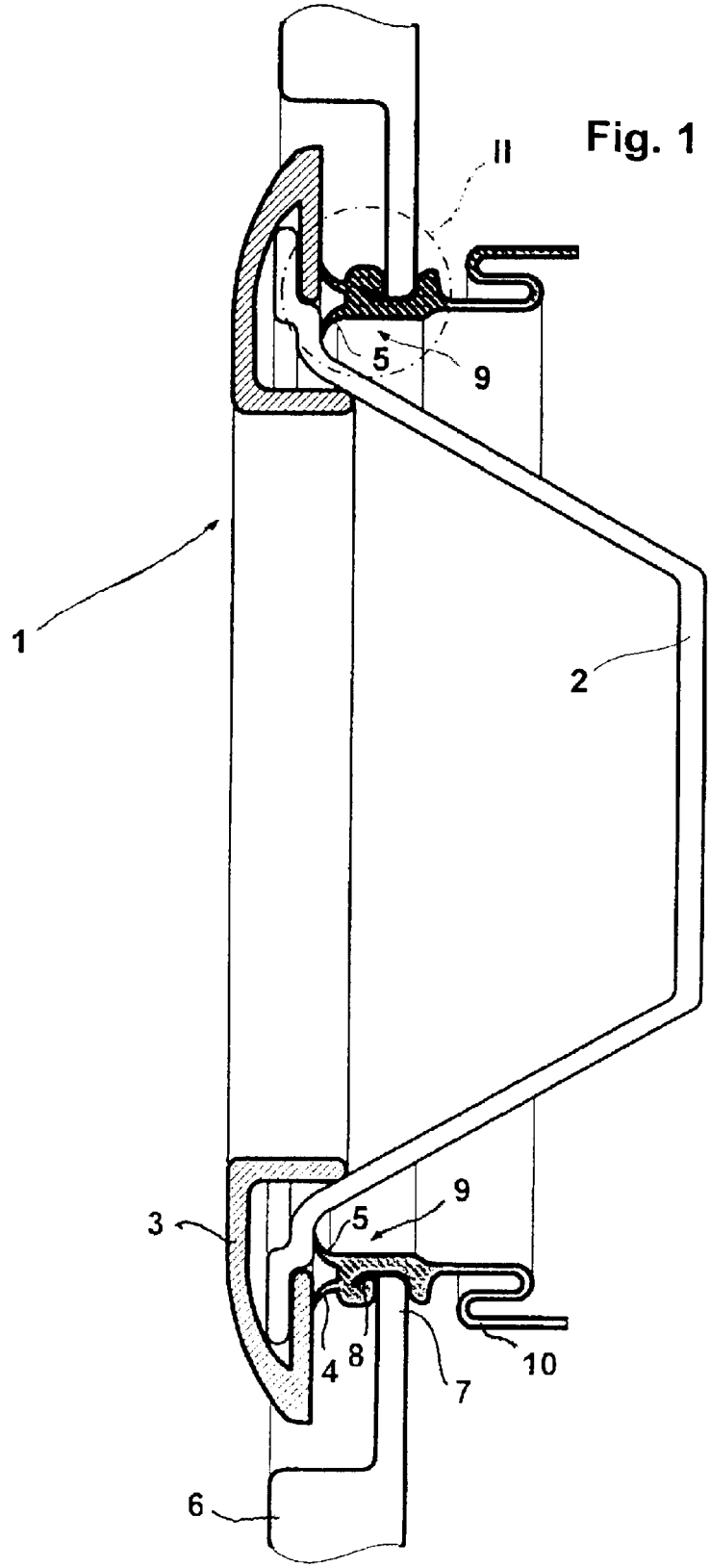
FIG. 1 is a fragmentary, vertical cross-sectional view through a door region of a front-loading washing machine according to the invention.

Referring now to the figures of the drawings in detail and first, particularly to FIG. 1 thereof, there is shown a cross-sectional view of a door region of a front-loading washing machine with a bull's-eye-type door 1 having a pot-shaped glass window 2, which is fixed in a frame 3. In the closed position of the door, sealing lips 4 and 5 lie on the inside of the edge region of the door 1 and prevent escape to the exterior of water from the interior space of the washing machine located to the right of the door.

The door 1 is fixed through a non-illustrated hinge on a window cutout of a housing 6 of the washing machine containing a pre-rolled sheet metal collar 8 in an edge region 7 of the window. The outer beading 9 of a sleeve 10 is buttoned onto the sheet metal collar 8. A clamping element 11, for example, an annular helical spring, set into the beading 9 clamps the beading 9 against the neck of the sheet metal collar 8.

Figure 2:
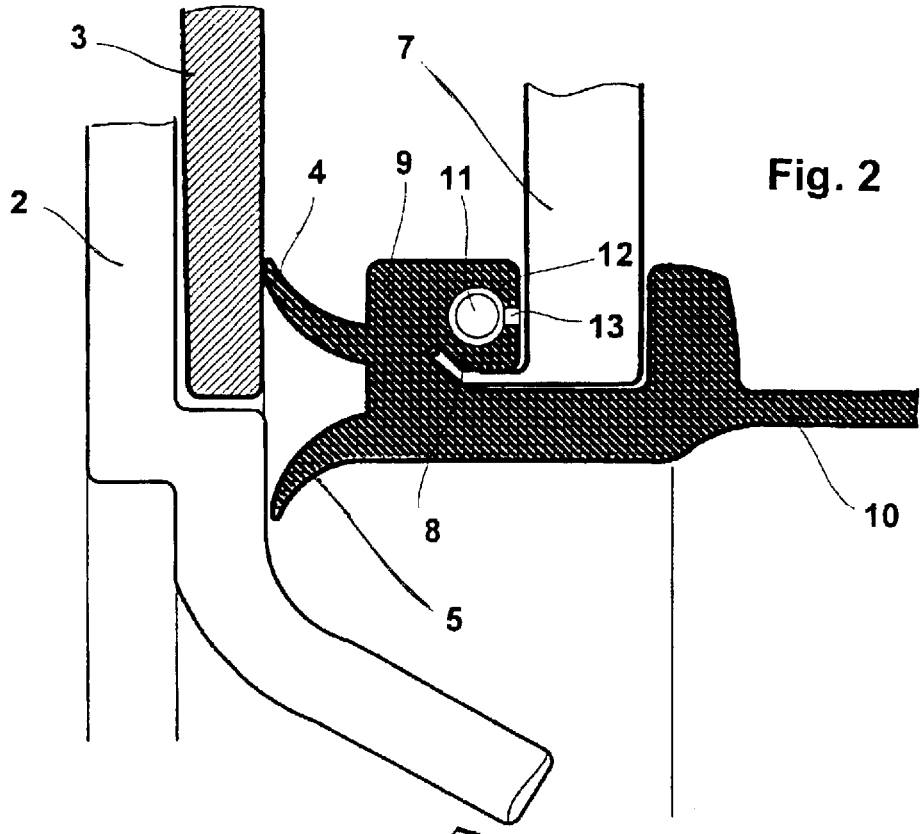
FIG. 2 is an enlarged, fragmentary, cross-sectional view of the encircled detail in FIG. 1 of a first embodiment of the securing region of the sealing sleeve according to the invention.
Figure 3:
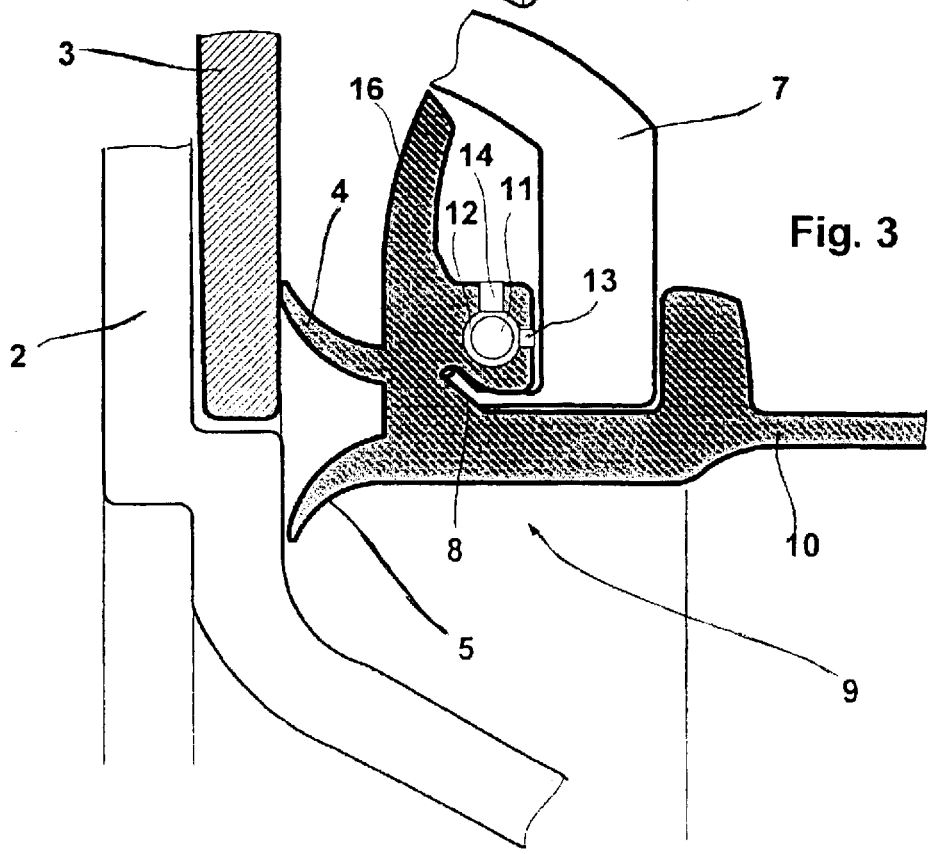
FIG. 3 is an enlarged, fragmentary, cross-sectional view of the encircled detail II in FIG. 1 of a second embodiment of the securing region of the sealing sleeve according to the invention.

FIGS. 2 and 3 show, in an enlarged cross-sectional view, the beading 9 of the sealing sleeve 10, which includes an annular channel 12 in its interior. The channel 12 is connected to the outer surface of the beading 9 of the sealing sleeve 10 through one groove 13 in FIG. 2 and through two grooves 13 and 14 disposed perpendicular to one another in FIG. 3. A substantially annular clamping element 11 is molded into the annular channel 12. A recess having approximately the shape of a quarter circle is molded into the beading 9 of the sealing sleeve 10, into which recess a rolled-up, substantially annular collar 8 of the edge of the front section of the housing wall 7 limiting the door aperture is introduced.

In the embodiment according to FIG. 3, in which the window edge region 7 of the front housing wall 6 has only a narrow, seamed-in edge, it is advisable to cover such an edge region with another annular lip 16 covering the edge region 7.

The sealing sleeve 10 is customarily produced by the injection molding process. In such a process, a corresponding mold is constructed and filled by injection under high pressure with a liquid and elastic material (for example, rubber), which later cures to become softly elastic. As a result, the sealing sleeve 10 can be formed in a predetermined shape with very detailed accuracy.

In principle, there are two possible ways of molding the clamping element 11 into the interior of the sealing sleeve 10. First, the mold can be equipped with a corresponding core for the subsequent channel 12 and at least one groove 13 or 14. Then, after curing of the injection molding material, it is possible to introduce the clamping element 11 through the groove 13 or 14 into the annular channel 12 in the interior of the beading 9 of the sealing sleeve 10.

Alternatively, the annular clamping element 11 can also be previously secured in the injection mold through an annular, continuous rib or through webs attached at individual points in the annular mold. During the subsequent injection molding, in such a case, the clamping element 11 is injected around the sealing sleeve 10 so that the clamping element 11 and the sealing sleeve 10 form a single component and it is no longer necessary to introduce the clamping element 11 into the channel 12. When individual webs are used, the beading 9 of the sealing sleeve 10 includes, after the injection molding, not a continuous groove 13 for connecting the channel 12 to the outside of the sealing sleeve 10 but a plurality of individual passage apertures corresponding to the shape of the retaining webs.

The use of a plurality of circular ribs in the injection mold serves to provide better retention of the clamping element 11. In such a case, after injection molding, a corresponding plurality of annular grooves 13 and 14 are formed in the beading 9 of the sealing sleeve 10.

In principle, any annular structure capable of automatic elastic further tensioning can be used as the clamping element 11, such as, for example, a tensioning cable or a rubber band of relatively high tensile force. Particularly preferred, however, is the use of a helical spring, also known as a "worm spring," as this retains its spring force even after a long period of operation and, thus, guarantees reliable sealing. It should be noted that, when injection takes place directly around a helical spring, the latter must previously be provided with a suitable sheathing, as, otherwise, material of the sleeve 10 penetrates between the individual coils of the spring during injection molding, which may result in a reduction of the spring force or even a complete elimination of the spring force.

In the above-mentioned embodiments, which are adapted to the customary embodiments of the curved, substantially annular collar 8 of the edge section 7 of the front housing wall 6 limiting the door aperture, the beading 9, with the clamping element 11 jointly injected around it during injection molding or pre-mounted in the channel 12 after injection molding, is merely inverted with its recess in the shape of a quarter circle over the correspondingly shaped collar 8. As a result of the spring force of the clamping element 11, the beading 9 of the sealing sleeve 10 is, then, permanently pressed against the collar 8, so that slipping of the sealing sleeve 10 is prevented.

The invention is not, however, confined to the embodiments described herein but includes all conceivable geometrical shapes, ranging from the simple rectangle to complexly configured beadings. The section of the sealing sleeve to be secured merely needs to be sufficiently thick to receive the clamping element in its interior. Thus, the subject of the present invention can be used in virtually any field in which sealing sleeves are employed.

We claim:

1. In a household appliance having an outer drum, a housing with a front wall, joints between the outer drum and the front wall, a suds container with an upper part, a top frame, and joints between the upper part and the top frame, a sealing sleeve for sealing at least one of the joints comprising:

a section to be secured in the appliance, said section having:

an interior; and a substantially annular clamping element being molded into said interior, securing said section in the appliance, and sealing at least one of the joints.

2. The sealing sleeve according to claim 1, wherein:

said section has an outer surface and an annular channel with at least one groove; and said channel:

is connected by said at least one groove to said outer surface of the sealing sleeve; and receives said clamping element.

3. The sealing sleeve according to claim 1, wherein said clamping element is mounted in said section.

4. The sealing sleeve according to claim 1 wherein said clamping element is mounted in said section between said clamping element and a mounting location in the household appliance.

5. The sealing sleeve according to claim 1, wherein said clamping element is injection molded.

6. The sealing sleeve according to claim 5, wherein said clamping element is jointly injection-molded around said section.

7. The sealing sleeve according to claim 5, wherein said clamping element is jointly injection-molded with said section.

8. The sealing sleeve according to claim 1, wherein said clamping element is elastic.

9. The sealing sleeve according to claim 1, wherein said clamping element is automatically capable of elastic further tensioning.

10. The sealing sleeve according to claim 9, wherein said clamping element is a helical spring.

11. The sealing sleeve according to claim 1, wherein said clamping element is a helical spring.

12. The sealing sleeve according to claim 1, wherein:

a front housing wall of the appliance limits a door aperture and has an edge with a curved, substantially annular collar; and said section is a beading and, with said clamping element, is adapted to engage with the annular collar.

13. A sealing section for a household appliance, comprising:

a body having an interior; and a substantially annular clamping element being molded into said interior, said clamping element adapted to secure said section in the appliance and to seal at least one of a joint between an outer drum and a front wall of a housing of the appliance and a joint between an upper part of a suds container and a top frame of the appliance.

14. In a washing machine having an outer drum, a housing with a front wall, joints between the outer drum and the front wall, a suds container with an upper part, a top frame, and joints between the upper part and the top frame, a sealing sleeve for sealing at least one of the joints comprising:

a section to be secured in the washing machine, said section having:

an interior; and a substantially annular clamping element being molded into said interior, securing said section in the appliance, and sealing at least one of the joints.

15. A washing machine, comprising:

an outer drum;

a housing with a front wall;

joints between said outer drum and said front wall;

a suds container with an upper part;

a top frame;

joints between said upper part and said top frame; and a sealing sleeve for sealing at least one of the joints, said sealing sleeve having:

a section having:

an interior; and a substantially annular clamping element being molded into said interior, securing said section in the appliance, and sealing at least one of said joints.

* * * * *